US005689154A

United States Patent [19]

Barthelmes et al.

[11] Patent Number: 5,689,154

[45] Date of Patent: Nov. 18, 1997

[54] METAL HALIDE GAS DISCHARGE LAMP FOR PROJECTION PURPOSES

[75] Inventors: Clemens Barthelmes; Thomas Dittrich; Ralf Seedorf, all of Berlin, Germany

[73] Assignee: Patent-Treuhand-Gesellschaft für elektrische Glühlampen mbH, Munich, Germany

[21] Appl. No.: 656,220

[22] PCT Filed: Jan. 20, 1995

[86] PCT No.: PCT/DE95/00067

§ 371 Date: May 30, 1996

§ 102(e) Date: May 30, 1996

[87] PCT Pub. No.: WO95/20822

PCT Pub. Date: Aug. 3, 1995

[30] Foreign Application Priority Data

Jan. 28, 1994 [DE] Germany ..... 94 01 436.1

[51] Int. Cl.[6] ..... H01J 61/30; H01J 61/35

[52] U.S. Cl. ..... 313/635; 313/113; 313/116

[58] Field of Search ..... 313/606, 116, 313/635, 639, 643, 620, 489, 112, 113, 114, 115, 571

[56] References Cited

U.S. PATENT DOCUMENTS

| | | | |
|---|---|---|---|
| 4,281,267 | 7/1981 | Johnson | 313/635 X |
| 4,701,664 | 10/1987 | Larue et al. | 313/635 X |
| 5,220,237 | 6/1993 | Maseki et al. | 313/635 X |
| 5,363,007 | 11/1994 | Fromm et al. | 313/635 X |

FOREIGN PATENT DOCUMENTS

| | | |
|---|---|---|
| 0 459 786 A3 | 12/1991 | European Pat. Off. . |
| 3283344 | 12/1991 | Japan . |

*Primary Examiner*—Ashok Patel

*Attorney, Agent, or Firm*—Frishauf, Holtz, Goodman, Langer & Chick, P.C.

[57] ABSTRACT

A metal halide gas discharge lamp for projection purposes includes a discharge vessel closed at both ends preferably has between the electrodes a central frosted partial area applied on the outer surface of the discharge vessel. The relationship $0.1<B\leqq 1$, preferably $0.4<B/d<0.8$, applies to the quotients of the width B of the frosted partial area by the inter-electrode gap d. The lamp is optionally provided on one or both sides with heat build-up coatings. The lamp advantageously forms a unit with an optical reflector.

9 Claims, 1 Drawing Sheet

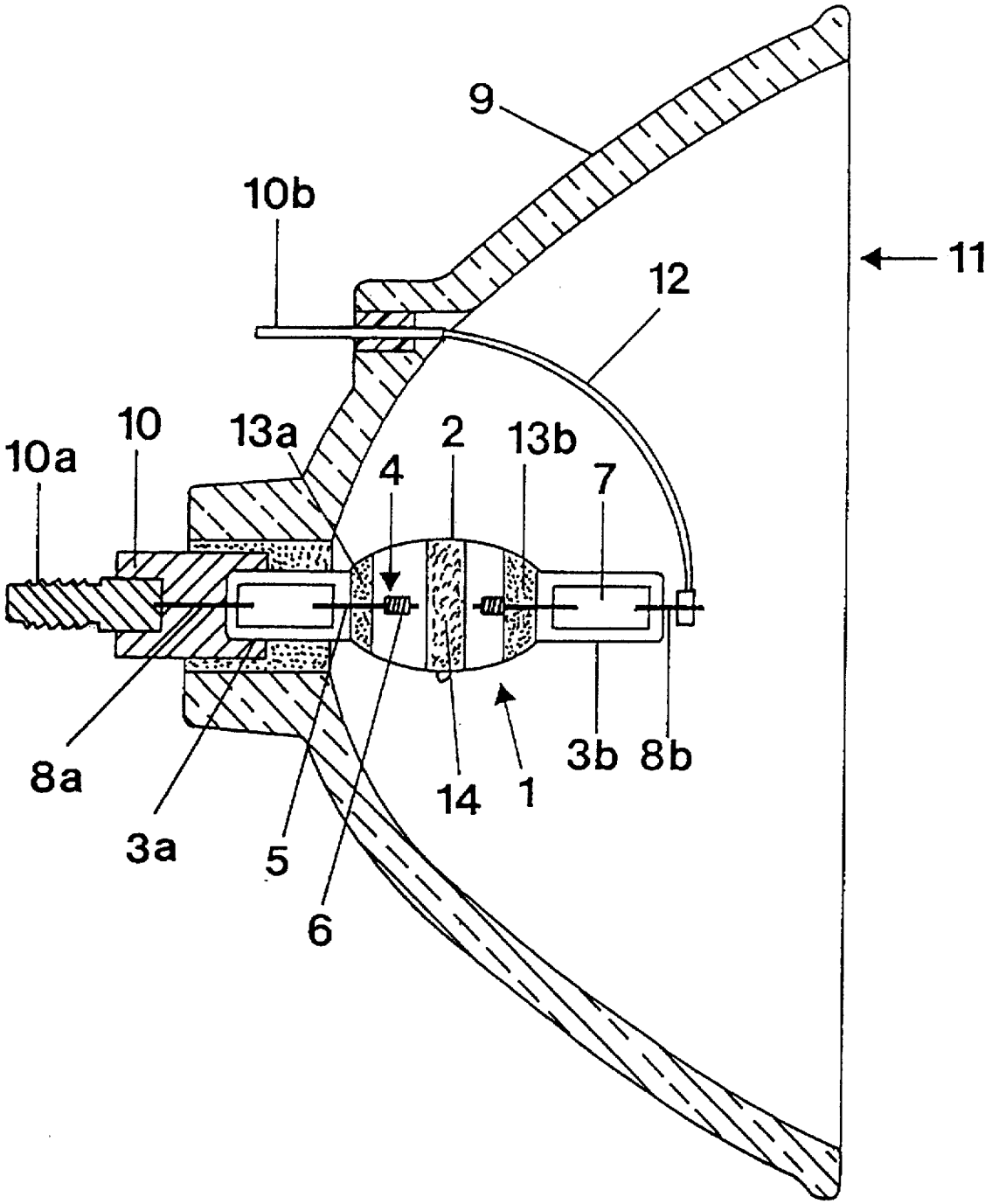
9
10b
11
12
10
13a
2
13b
10a
4
7
8a
3a
5
6
14
1
3b
8b

METAL HALIDE GAS DISCHARGE LAMP FOR PROJECTION PURPOSES

FIELD OF THE INVENTION

The invention is based on a metal halide gas discharge lamp, particularly suitable for video projection, endoscopy, or for medical technology, e.g. operating room lights.

They are especially suitable for video projection using liquid crystal technology (LCD), and especially for large-picture television screens with an aspect ratio of 16:9. Typical power ratings are from 100 to 1500 W.

BACKGROUND

The lamps suitable for these uses must have not only a high light yield but above all good to very good color reproduction. This is true particularly in combination with reflectors of the kind used for projection purposes. Uniform distribution of luminance and color over the projection surface is of great importance in that case.

U.S. Pat. No. 5,220,237, Maseki et al, to which European Patent Application EP-A 0 459 786 corresponds, discloses this kind of lamp with a reflector. To meet the stated requirements, the surface of the discharge vessel, in the region of a first electrode, has a reflecting/thermal insulating film—hereinafter, "heat buildup coating" for short. This is immediately followed by a region where the surface is frosted. This region extends at least as far as the middle between the two electrodes and at most as far as the middle of a wire wound around the second electrode. The lamp is designed to be installed axially in a reflector. Perpendicular to the reflector axis, one or optionally both of the arc cores that occur in the immediate vicinity of the electrode in alternating current operation is covered by the frosting. A disadvantage is that as a result a considerable portion of the radiation originating at these arc cores is lost to projection through the reflector because of scattering at the frosted portion. As a result, the effectively usable light yield of the lamp and reflector system also drops.

THE INVENTION

It is an object of the present invention is to eliminate this disadvantage and to provide a lamp for projection purposes with a better light yield that is moreover distinguished by homogeneous color distribution, good color reproduction, and a long service life.

Briefly, the frosting of the surface of the discharge vessel is limited to a region or a strip between the electrodes. The width of the frosted surface is smaller than, or at most the same width as, the spacing of the electrodes. A region of the bulb with a clear surface adjoins the frosted region. It is thus assured that a great majority of the radiation of both arc cores will pass as oriented radiation through the clear or in other words unfrosted surface. It can then be efficiently projected optically with the aid of a suitable reflector, e.g. a parabolic reflector. By suitable selections the width of the frosted surface and the roughness of the frosting, a compromise can be attained between the light flux and the uniformity of the illumination. Depending on requirements, the quotient of the width B of the frosted surface and the spacing d of the electrodes can vary in the range of $0.1 < B/d \leqq 1$. Particularly good results are attained with quotients between 0.4 and 0.8. Preferably, the frosting is applied to the surface of the discharge vessel centrally between the electrodes.

The advantage of the invention becomes clear if one compares the drop in light flux of a lamp caused by conventional frosting—as taught by EP-A 0 459 786—to that resulting from frosting according to the invention. While in the first case, and according to the prior art, the usable light flux drops to 65% from a clear lamp, a comparable lamp according to the invention, with identical uniformity of the illumination, still attains typically 80% of the light flux of the unfrosted lamp.

The discharge vessel comprises a translucent material, such as quartz glass. It is hermetically sealed on two ends, for instance by pinch seals, and can be coated on one or both ends with a heat buildup coating. An important characteristic is that in each case, both edges of the frosted surface are initially adjoined by a clear or in other words uncoated region. This clear region of the surface can be made variously wide at the two ends, thus producing two heat buildup coatings that likewise have different lengths. If the lamp is operated in a vertical position, the shorter heat buildup coating is located at the top. In this way, it is possible to counteract a temperature difference resulting from convection between the upper and lower end of the discharge vessel, and as a result the light yield can be increased.

Advantageously, the lamp is combined with a reflector to make a structural unit of the kind described in EP-A 459 786. The lamp is mounted approximately axially in the reflector. The reflector has a dichroic coating, for instance. In a preferred embodiment, the lamp is oriented in the reflector such that the shorter heat buildup coating is located in the vicinity of the apex of the reflector. Shading of the reflector is thus kept slight and consequently the light yield is optimized.

DRAWINGS

One exemplary embodiment will be described in further detail below in conjunction with the drawing.

The single FIGURE of the drawing is a schematic side view illustration of the lamp and reflector, partly in section.

DETAILED DESCRIPTION

The drawing shows a metal halide lamp 1 with a power of 170 W and a discharge vessel 2 of quartz glass, which is pinched on both ends, as seen at 3*a* and 3*b*.

The discharge volume is 0.7 $cm^3$. The axially opposed electrodes 4 are spaced apart by 5 mm to form an inter-electrode gap d. They comprise an electrode shaft 5 of thoriated tungsten, over which a coil 6 of tungsten is slipped. The shaft 5 is joined to an external power supply lead 8 in the region of the pinch 3*a* via a foil 7.

The lamp 1 is located approximately axially in a paraboloid reflector 9; the arc that develops in operation between the two electrodes 4 is located at the focal point of the paraboloid. Part of the first pinch 3*a* is seated directly in a central bore of the reflector, where it is retained in a base 10 by means of cement, and the first power supply lead 8*a* is joined to a screw base contact 10*a*.

The second pinch seal 3*b* is oriented toward the reflector opening 11. The second power supply lead 8*b* is joined in the region of the opening 11 to a cable 12, which is returned in insulated fashion through the wall of the reflector back to a separate contact 10*b*. The outer surfaces of the ends of the discharge vessel are coated with $ZrO_2$ for heat buildup purposes. A distal heat buildup film 13*b* toward the reflector opening 11 has a greater length than a proximate, with respect to the base, heat build-up film 13*a* axially opposite film 13*b*.

Centrally between the electrodes 4, the central portion 14 of the discharge vessel 2 is frosted.

In accordance with a feature of the invention, the frosting is a ring-like strip, adjoined at both sides by regions of clear quart glass. The width B of the frosting is 3 mm. The ratio B/d between the width B and the interelectrode gap d becomes 0.6. The mean illuminance is 6080 lx; an illuminance of 13180 lx results in the middle of the projection screen (whose total surface is divided into 3×3 individual surfaces).

The fill of the discharge volume contains, along with 200 mbar of argon and mercury, 1.15 mg of $AlI_3$, 0.1 mg of InI, and 0.36 mg of HgBr.

We claim:

1. A metal halide gas discharge lamp (1) for projection purposes, having a translucent discharge vessel (2) closed on two ends (3);

an ionizable fill within the vessel;

two opposed electrodes (4) in the vessel, separated by an interelectrode gap, connected to power supply leads (8) carried to the outside; and a frosting forming a strip-like portion (14) on the circumference of the outer surface of the discharge vessel (2), characterized in that the frosted portion (14) is located in alignment with the interelectrode gap, and has a width which is less than or at most equal to the electrode spacing defining said interelectrode gap; and regions of clear surface of said vessel (2) adjoin each of the edges of the strip-like portion of the frosted outer surface.

2. The metal halide gas discharge lamp of claim 1, characterized in that for the quotient of the width B of the frosted portion and said interelectrode gap formed by the electrode spacing d, the relation $0.1<B/d\leqq 1$ applies.

3. The metal halide gas discharge lamp of claim 2, characterized in that the quotient B/d is in the range between 0.4 and 0.8.

4. The metal halide gas discharge lamp of claim 1, characterized in that the strip-like frosted portion (14) is located centrally between the electrodes (8).

5. The metal halide gas discharge lamp of claim 1, characterized in that a heat build-up coating is applied to the outer surface of at least one end (13) of the discharge vessel (2), and said region of clear surface of the discharge vessel (2) extends between each build-up coating (13) and the frosted portion (14).

6. The metal halide gas discharge lamp of claim 5, characterized in that the heat build-up coating (13) extends in a region between the power supply lead (8) and the electrode tip.

7. The metal halide gas discharge lamp of claim 5, characterized in that the lamp is a double-ended lamp;

both ends are provided with a heat build-up coating, and the regions between said strip-like frosted portion (14) and the heat build-up coatings (13), and having a clear surface, are of different widths.

8. The metal halide gas discharge lamp of claim 1, characterized in that the lamp forms a structural unit with an optical reflector.

9. The metal halide gas discharge lamp of claim 7 in combination with a reflector, characterized in that the region having the clear surface that has a lesser width is located farther away from the apex of the reflector.

* * * * *